US008221116B2

(12) United States Patent
Biagioli et al.

(10) Patent No.: US 8,221,116 B2
(45) Date of Patent: Jul. 17, 2012

(54) GAS BURNER

(75) Inventors: Nico Biagioli, San Sepolcro (IT); Piero Armanni, Forli (IT); Marco Starnini, Forli (IT); Cedric Catalogne, Martignacco (IT)

(73) Assignee: Electrolux Home Products Corporation N.V., Brussels (BE)

( * ) Notice: Subject to any disclaimer, the term of this patent is extended or adjusted under 35 U.S.C. 154(b) by 635 days.

(21) Appl. No.: 12/309,971

(22) PCT Filed: Jul. 25, 2008

(86) PCT No.: PCT/EP2008/059779

§ 371 (c)(1),
(2), (4) Date: Feb. 5, 2009

(87) PCT Pub. No.: WO2005/078342

PCT Pub. Date: Aug. 25, 2005

(65) Prior Publication Data

US 2010/0233643 A1 Sep. 16, 2010

(30) Foreign Application Priority Data

Oct. 23, 2007 (EP) ..... 07119078

(51) Int. Cl.
*F23D 14/04* (2006.01)

(52) U.S. Cl. ..... 431/284; 431/278; 431/354; 431/355; 431/281; 431/264; 126/39 E; 126/39 R; 126/39 BA; 126/39 K; 126/39 J; 239/561; 239/560; 239/568

(58) Field of Classification Search ..... 431/284, 431/278, 354, 355, 285, 198, 200, 281, 195, 431/264; 126/39 E, 39 R, 39 BA, 39 N, 39 K, 126/39 J; 239/561, 560, 568
See application file for complete search history.

(56) References Cited

U.S. PATENT DOCUMENTS 2,180,789 A * 11/1939 Browning ..... 431/263
(Continued)

FOREIGN PATENT DOCUMENTS

DE 85 13 182 8/1985
(Continued)

OTHER PUBLICATIONS

International Search Report mailed Nov. 7, 2008 for International Application No. PCT/EP2008/059779.

(Continued)

*Primary Examiner* — Steven B McAllister
*Assistant Examiner* — Avinash Savani
(74) *Attorney, Agent, or Firm* — Wenderoth, Lind & Ponack, L.L.P.

(57) ABSTRACT

Gas burner provided with a plurality of concentric flame crowns, and comprising a first central burner to supply a peripheral flame ring, a second annular burner surrounding the central burner at a defined distance and able of supplying at least a respective peripheral ring, a burner body apt to be mounted on the surface of a cooking hob, a first gas inlet in communication with the body, a first vertical gas injector, the central burner being provided with a first chamber for the diffusion of the air/gas mixture, a second gas inlet in communication with the body, wherein the second annular burner is provided with two separate chambers for the diffusion of the mixture, wherein the second gas inlet is in communication with the two separate chambers through suitable injection and conveying means, which comprise two distinct injectors in communication with the second gas inlet, and two respective horizontal Venturi pipes each of which being able of supplying with the air/gas mixture a respective of the two diffusion chambers; these are physically separate and not in communication to each other. The two horizontal and separate injectors are placed on the same end position of the second gas inlet.

12 Claims, 7 Drawing Sheets

U.S. PATENT DOCUMENTS

| | | | | | |
|---|---|---|---|---|---|
| 2,201,077 | A | * | 5/1940 | Browning | 431/280 |
| 2,203,165 | A | * | 6/1940 | Levine | 431/199 |
| 2,297,762 | A | * | 10/1942 | Harper | 431/193 |
| 2,450,680 | A | * | 10/1948 | Mueller | 431/284 |
| 2,640,531 | A | * | 6/1953 | Lamar | 431/284 |
| 2,661,057 | A | * | 12/1953 | Resek | 239/424.5 |
| 5,401,164 | A | * | 3/1995 | Yen | 431/354 |
| 5,704,778 | A | * | 1/1998 | Hsieh | 431/354 |
| 5,842,849 | A | * | 12/1998 | Huang | 431/284 |
| 6,132,205 | A | | 10/2000 | Harneit | |
| 6,315,552 | B1 | * | 11/2001 | Haynes et al. | 431/285 |
| 2001/0010897 | A1 | | 8/2001 | Dane | |

FOREIGN PATENT DOCUMENTS

| | | |
|---|---|---|
| EP | 1 120 603 | 8/2001 |
| WO | 2004/044490 | 5/2004 |
| WO | 2005/073630 | 8/2005 |
| WO | 2005/078342 | 8/2005 |
| WO | 2006/005428 | 1/2006 |
| WO | 2006/114063 | 11/2006 |
| WO | 2007/012766 | 2/2007 |

OTHER PUBLICATIONS

Written Opinion of the International Searching Authority mailed Nov. 7, 2008 for International Application No. PCT/EP2008/059779.

* cited by examiner

Section A-A

Section B-B

Section C-C

GAS BURNER

BACKGROUND OF THE INVENTION

I. Field of the Invention

The present invention relates to an improved, preferably household gas burner, generally used in the cooking gas appliances.

In the following description it will be referred to as a gas burner provided with both a central body with a peripheral flame crown, and a peripheral body provided with two flame crowns, oriented inwards and outwards, but it will be intended that what is explained may be identically applied, and therefore valid, also to gas burners provided with only a peripheral body, that is without the central flame body.

II. Description of the Related Art

Gas burners are known that are provided with a plurality of flame crowns which assure an homogeneous distribution of the generated thermal power, and therefore provide a uniform heating of the cooking containers/pans placed over the gas burners.

A particularly efficient embodiment of such burners is one which comprises a central body and an outer annular body, the two bodies being basically circular, coaxial and separated to each other by a suitable distance which is horizontally extended, and obviously also shaped as a ring; as such burners are universally used, it is cited, only for documentation, U.S. Pat. No. 6,132,205.

Such burners have been experienced to be particularly efficient as they are able to generate, inside a limited surface, a high specific thermal power, just because they are based on the provision of grouping a certain number, preferably three, concentric flame crowns.

However such burners are not deprived of some drawbacks which limit their use and performances; as a matter of fact, they often show two injectors and two respective Venturi pipes, one feeding the central burner, and the other feeding the outer annular burner.

Moreover it is known that such arrangement allows the delivery thermal powers which can hardly exceed 4-4.5 kW.

It is also known that a Venturi pipe becomes more efficient when its length is proportional to the Venturi throat diameter, and it is also well known that the latter dimension determines the burner thermal power. As a consequence, to delivery large power, it is needed to provide long-neck Venturi pipes, able of sucking more air and to closely mix the air with the gas.

As the central burner size is unavoidably limited, it would be in any case not able of providing a high thermal power; therefore the respective gas injector and respective Venturi pipe may be limited in their extension, and so the injector and the respective Venturi pipe may normally be oriented vertical, without causing a remarkable penalization.

As a matter of fact, it is here reminded that the height of the cooking gas hobs, specifically for household use, must be comprised within definite limits, usually 30 to 40 mm.; therefore a limited height of the Venturi pipe for the central burner turns to be also compatible with such height limit, and so the vertical orientation of the Venturi pipe which is shorter for the central burner becomes compatible both with its limited thermal power that can be delivered, and with its vertical height that can be admitted.

The case of the outer annular burner is different; in such a case, it is needed to deliver high thermal power, and this need hinders the bounds of a properly prolonged and vertically positioned Venturi pipe.

In order to overcome such a drawback it is known, for instance from WO 2004/044490 A1, U.S. Pat. No. 6,132,205, WO 2005/073630 A1, WO 0712766 A1, WO 2005/078342 A1 to split the gas flow into a plurality of usually two or three separate and distinct injectors, and respective Venturi pipes which are obviously distinct as well.

As a matter of fact, it is also known to split the gas flowing means (injectors and Venturi pipes) into a plurality of conduits showing a lower delivery and so with a lower single thermal power, but also with shorter lengths, easily allowing to reach and also to overcome the power of a single conduit (injector and Venturi pipe) having the same gas delivery as the sum of the gas deliveries of the previous conduits.

However even such conditions do not properly offer the best compromise between:

the desired minimum vertical size of said gas conduits, the burner geometric shape and size, which appear to be over-sized with respect to the cooking pots/containers, and the maximization of the overall deliverable power, as the conduits (injectors and related Venturi pipes) are in any case vertical, and the fact that they are vertical restricts their length, and therefore the deliverable thermal power.

Moreover, as the pipes must be lodged inside the burner, it turns that, when their number increases, the burner becomes more and more cumbersome.

This circumstance causes a performance decrease, as the heat is being transferred from the burner to the sides of the cooking pot, instead of on its bottom; as a consequence the heat transfer is obviously hindered, and the gas consumption and cooking time are experienced.

WO 07012766A1 and WO 2005/078342 respectively show three and two conduits which are remarkably inclined on the horizon, but the conduits (injectors and Venturi pipes) also originate on the burner central axis, and therefore they stretch radially for only an extension which is similar to about the burner radius, within limits their length, and consequently the deliverable thermal power; moreover the injectors positioning in the burner centre, i.e. far away from the burner side edge, obstacles the primary (A) and secondary (B) air inlets, due to the over-heating and of the consequent gas rarefaction.

In order to overcome such a drawback, from EP 1120603 B a kind of gas burner of the generally described kind is known, with three coaxial flame crowns generated by burners split into a central body and a outer annular body, wherein an injector and a respective Venturi pipe are arranged to feed the outer annular body and which are placed both in horizontal and for the whole extension of the burner lower diameter.

Such a solution apparently overcomes the bound due to the limited extension in the length of the gas conduit, as it makes use of the maximum available extension; however in this case too it is not possible to deliver the maximum possible power as the gas conduit is only one, being that there is not any splitting in the gas conduits implemented; as a consequence there is an apparent discrepancy between the horizontal arrangement of the gas conduit, which prolonging the Venturi pipe, increases its power, and the singleness (no splitting) of the injector and of the Venturi pipe, which prevents the full exploitation of the available room to maximize the theoretically installable thermal power.

Moreover like solutions more precisely suffer primary air rarefaction, caused by the heating induced by the working burner itself; this can be demonstrated by the presence of tips of yellow flames after about ten minutes from the burner ignition.

Furthermore, the fact of placing the Venturi pipe in the centre of the lower burner portion apparently hinders, creating further functional and constructive problems, the injector assembly and the lodging of the related vertical Venturi pipe which feeds the central body and which evidently has to pass through the burner axis, which in the presently cited patent is instead taken by the horizontal Venturi pipe.

SUMMARY OF THE INVENTION

It would therefore be desirable, and is actually a main purpose of the present invention, to provide a type of gas burner provided with a central body and with a peripheral annular body separate to each other, which are provided with respective injectors and Venturi pipes, and which are not vertically placed and are able of exploiting basically the whole burner cross size (width) in order to allow the lodging of a plurality of separate Venturi pipes, increasing the overall deliverable thermal power, but still permitting adjustment of the burner to another gas set up by replacing the injectors without disassembling any part of the appliance.

BRIEF DESCRIPTION OF THE DRAWINGS

According to the present invention, this and further aims are reached in a kind of burner incorporating the characteristics as recited in the appended claims and including such operating means as described below by mere way of non-limiting example with reference to the accompanying drawings, in which:

DETAILED DESCRIPTION OF THE INVENTION

Figure 1:
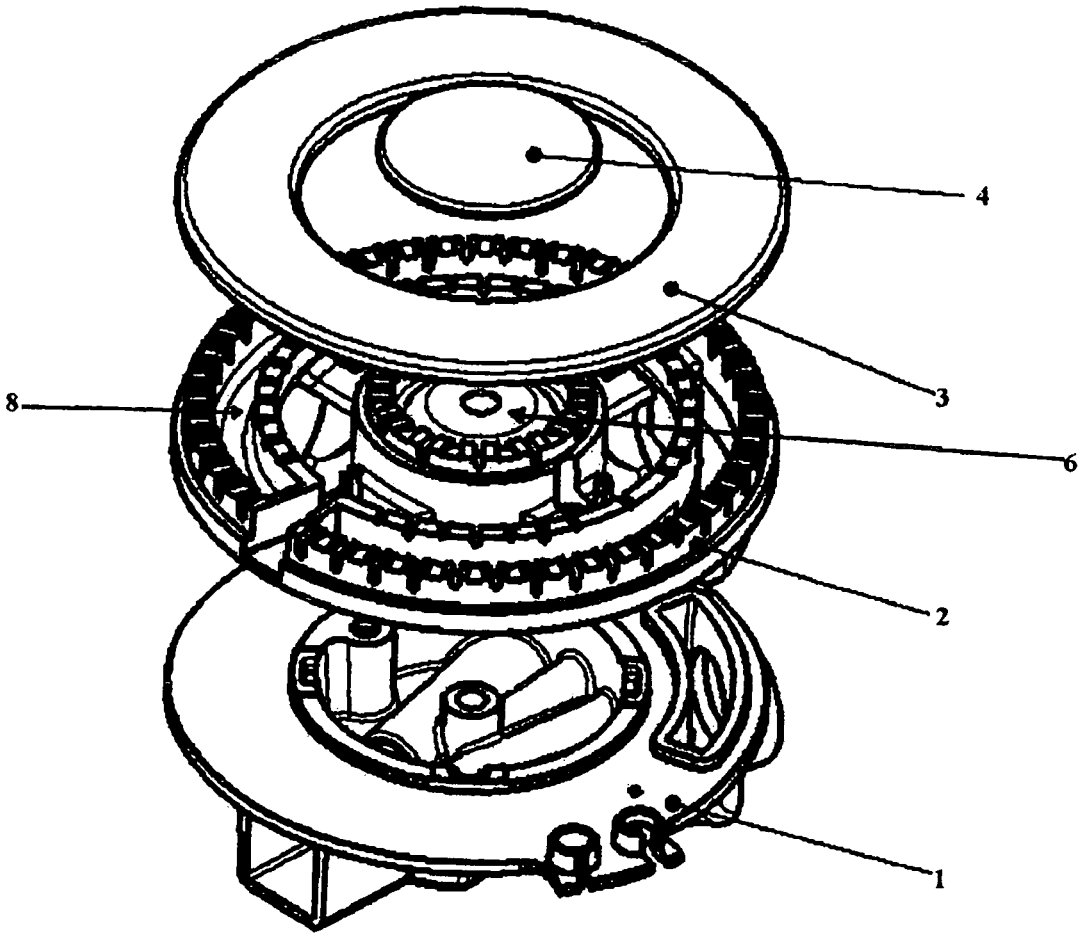
FIG. 1 shows a perspective and exploded view of a burner according to the invention.

With reference to FIGS. from 1 to 6, a gas burner according to invention, and typically devoted to fit out a cooking appliance, not shown, comprises:

a burner body 1 and an upper crown 2, which are connected by the layer 5 and covers 3, 4, a first central and circular burner 6, per se known, able of feeding a peripheral flame crown 7, and a second annular peripheral burner 8 which surrounds the first central burner 6 at a definite distance thereof, provided with suitable adducting means to the inner flame crowns, of secondary air (B), the second annular burner having one or more flame crowns which are either inwards 9, i.e. oriented towards the first burner, or outwards 10, or both the arrangements.

The burner body includes, in a well known way, a conduit which acts as a first gas entrance 11, which ends into a first vertically oriented injector 12 and a related first Venturi pipe 13 which is vertical as well, which are designed and arranged to feed said first central burner 1.

According to the invention, the means to lead the gas into the second annular burner 8 comprise a second gas burner inlet 13 which enters the burner body and which reaches an end position 14, wherefrom two distinct gas paths are originated, wherein each path comprises a respective injector 15, 16 and a respective Venturi pipe 17, 18.

The end position 14 is practically arranged on the outer lower side of the burner body, i.e.: where the second gas entrance 13 enters the volume of the burner body, there it terminates to the end position 14.

Both said two injectors 15, 16 and the relevant Venturi pipes are horizontally oriented and basically lie on the same plane of the second entrance 13.

The two Venturi pipes 17 and 18, moreover do extend till the diametrically opposed portion of the burner body, with respect to the end position 14, and therefore from the zone said Venturi pipes admit into the gas diffusion chamber of the gas-air mixture, as it will be explained later on.

One skilled in the art will have surely already guessed that with this simple solution the main purpose of the invention is reached, as:

the presence of the two injectors and related Venturi pipes implements the desired power splitting, which reduces the consequence of the over-heating on the yellow tips, the horizontal orientation of the injectors and related Venturi pipes allows an efficient exploitation of the horizontal size of the burner body, avoiding the bound made by the maximum height let by the burner itself, and even more, the circumstance of extending the Venturi pipes from a side to the opposite side of the horizontal diameter of the burner body allows maximization of the Venturi pipes length that, as before reminded, allows improvement of the deliverable thermal power and therefore optimization of the ratio between the burner size and the (high) power.

Figure 2:
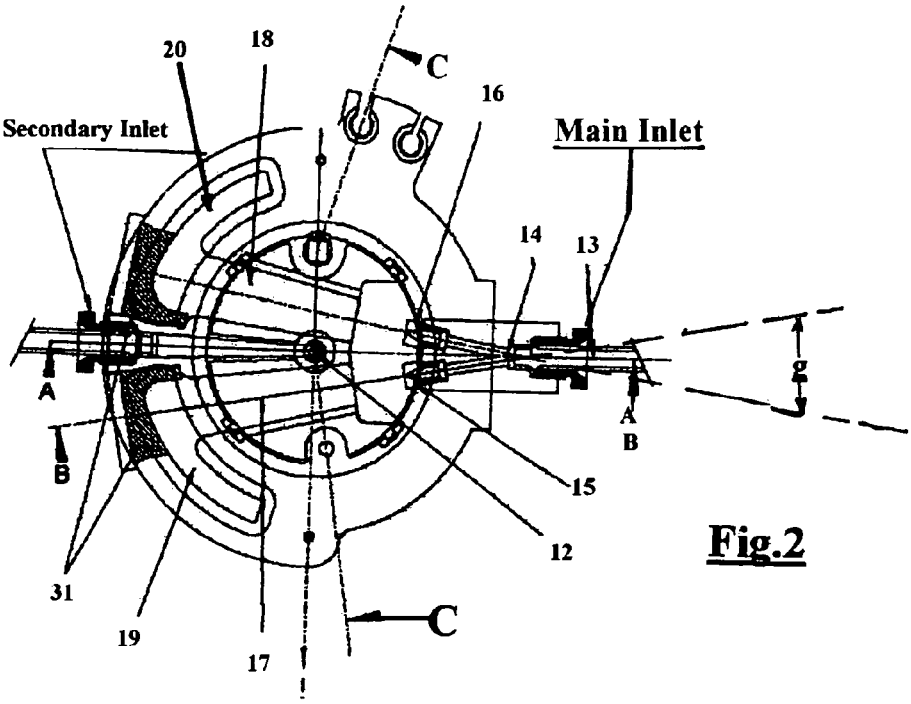
FIG. 2 shows a plan transparent and top view of a burner according to a first embodiment.
Figure 3:
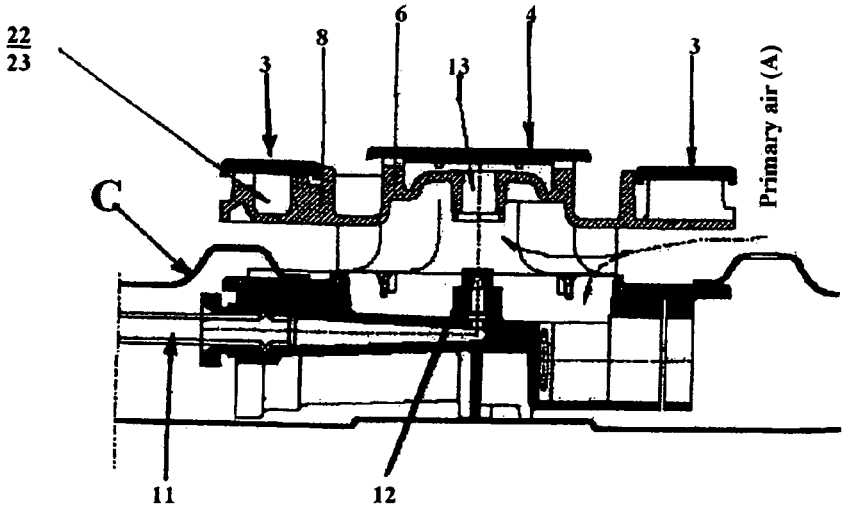
FIGS. 3, 4 and 5 show respective vertical views of the burner of FIG. 2, according to the respective sections A-A, B-B, C-C.

The just described solution allows some profitable improvements which further make easier the burner functional flexibility; a first improvement consists in the fact that the injectors 15, 16, branching out from the same end position 14, are logically oriented so as to show an acute angle "g" between them, as shown in FIG. 2.

Figure 7:
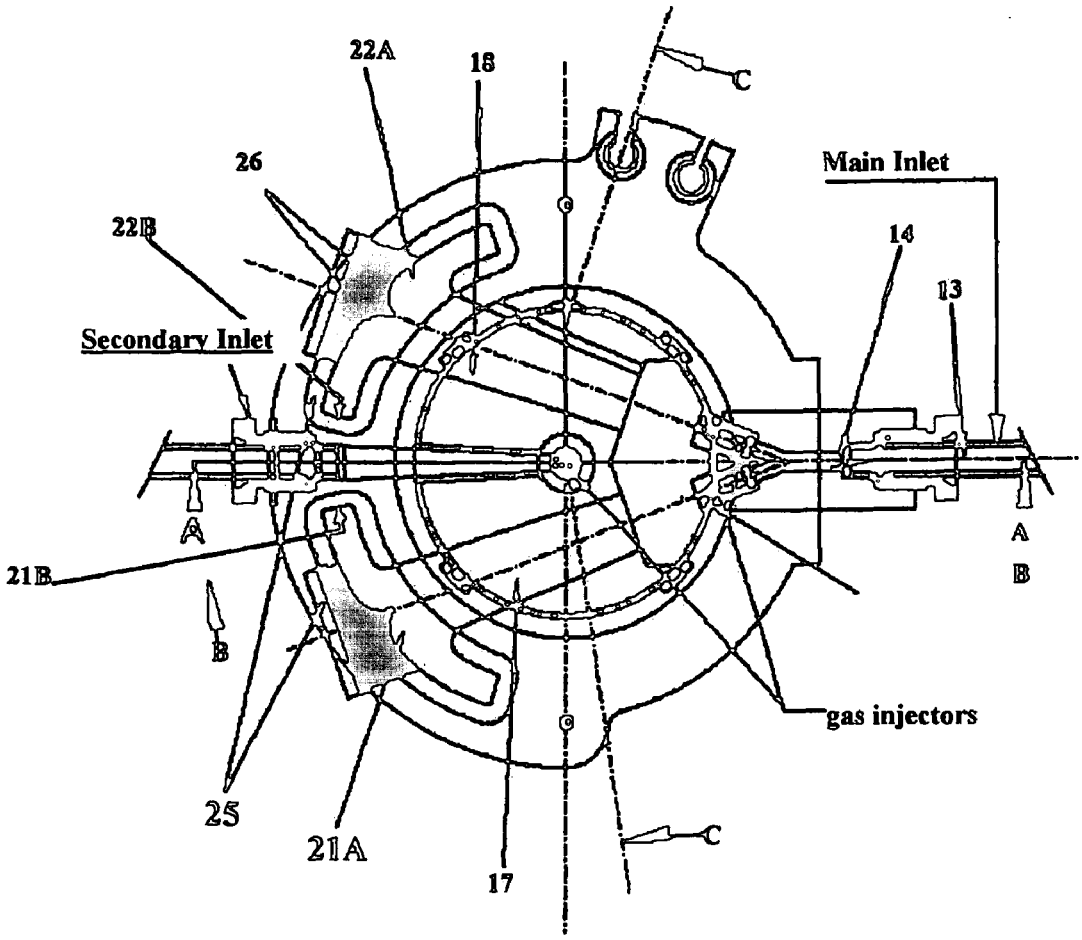
FIG. 7 shows a plan and top view of a burner according to an improved embodiment of a gas burner.

Obviously even the two Venturi pipes 17, 18 are oriented in a way aligned with the respective injectors 15, 16, that is are angled between them, and this permits that in the axial, that is in central zone of the burner body, the two Venturi pipes be diverted at a certain distance, which allows the arrangement and passage between them of the vertical injector 12 and related Venturi 13 which, having to feed the central burner 6, have to be necessarily axially placed and therefore in a position between said two Venturi pipes 17, 18, as shown in the FIGS. 2 and 7.

The second improvement consists in that, in order to optimize the functional and productive features, the two injectors 15 and 16 and related Venturi pipes 17, 18 are symmetrically positioned with respect to a vertical symmetry plane, logically passing through the central axis "X" (see FIG. 4) of the burner body.

The two Venturi pipes 17, 18 admit into respective gas diffusion chambers, which are placed above through the conduits 19, 20, (FIG. 4) and are provided with suitable ports leaving the air-gas mixture to flow out to be burned.

Figure 6:
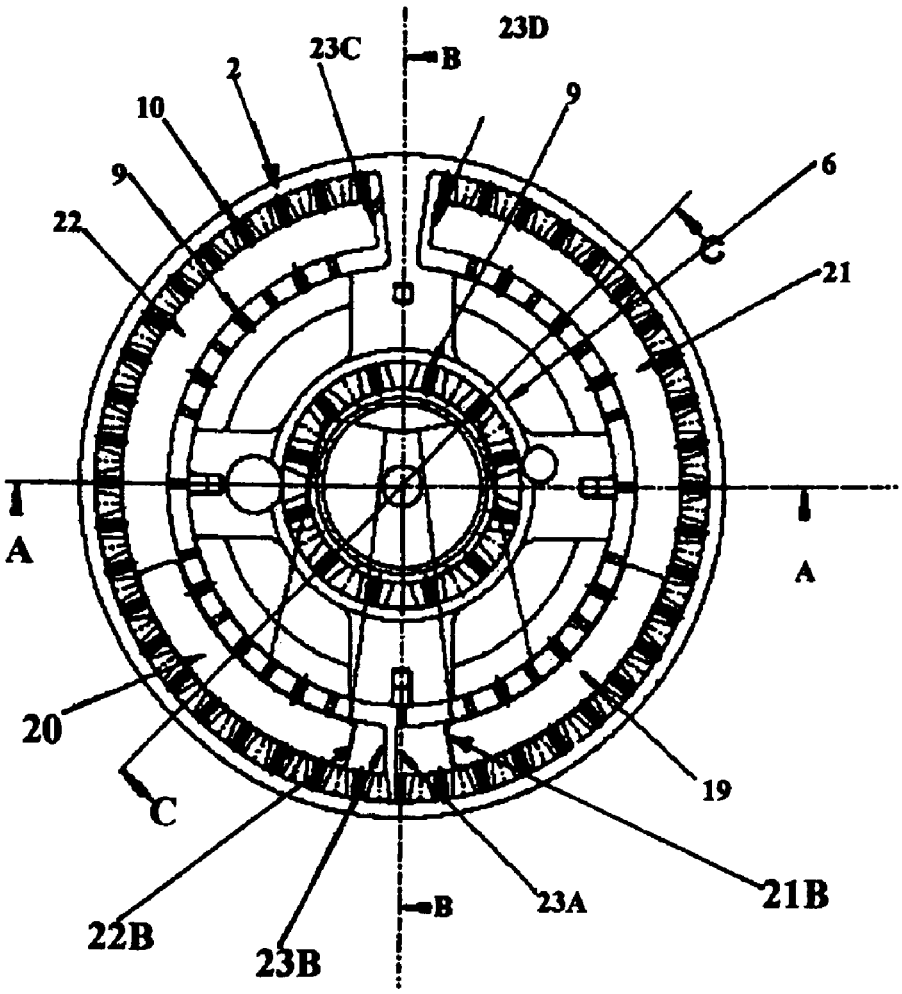
FIG. 6 shows the top plan view of the burner crown (particular 2 of FIG. 1) relative to the body of FIG. 2, without the covers of the chambers diffusing the air-gas mixture.

Advantageously the diffusion chamber is divided into two separate and not intercommunicating chambers 21, 22, through suitable vertical septa 23A, 23B, 23C, 23D, as shown in FIG. 6, and each of the Venturi pipes admit into only one of the respective chambers 21, 22.

Therefore the advantage is achieved that the combination of injector, related Venturi pipe and diffusion chamber actually implements a two burner assembly, in which the burners are mechanically and functionally autonomous.

Moreover, the presence of the two Venturi pipes and of the two related separate diffusion chambers, supplied with only one gas source 14 (FIG. 2), allows improvement the burner safety because in the case of an injector occlusion, any unburnt gas is prevented from lighting back into the burner itself.

As a conclusion not one but two peripheral and wholly independent burners may be obtained, and such independence allows much better flexibility both in the size and in the operation of each burner alone.

Figure 4:
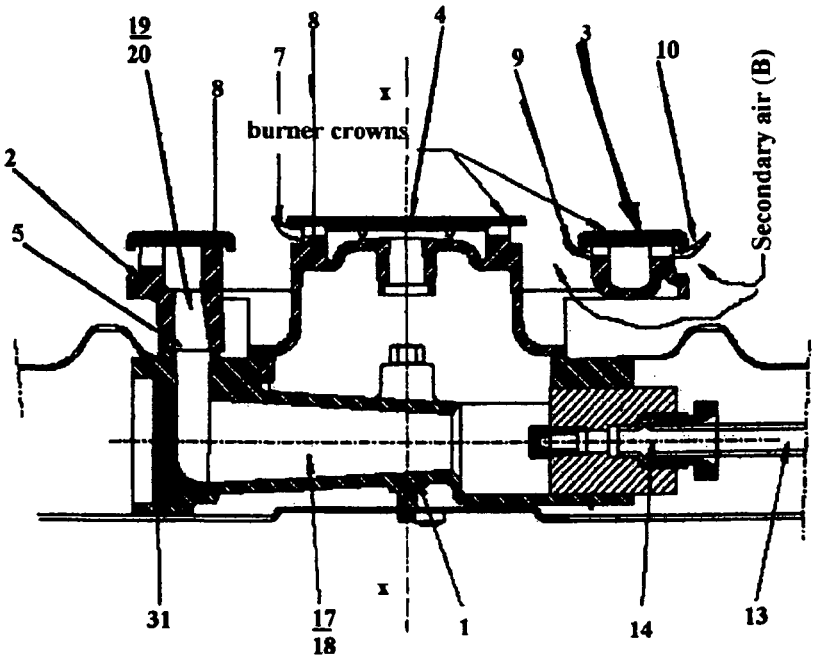
Figure 5:
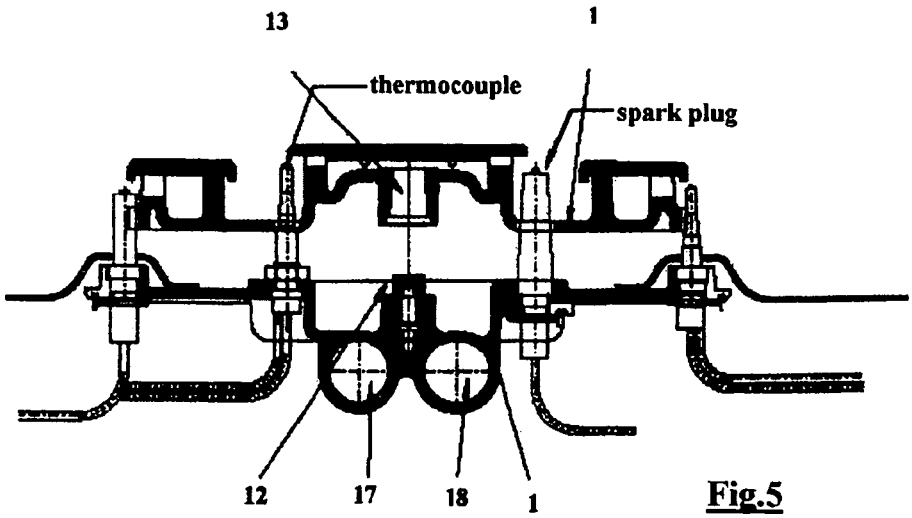

With reference to FIGS. 2, 4 the access of the two Venturi pipes into the respective chambers may be properly improved by providing the pipe fittings between the gas conduits with special deflection means 31, able to ease the air/gas mixture passage from the Venturi pipe into the respective conduits 19, 20 and to uniformly convey the mixture into the respective chambers 21, 22.

It is to be noted, in the facts, that the Venturi pipe of this invention is horizontal, as it is the diffusion chamber either, but this one is arranged at an higher level than the respective Venturi pipe.

Therefore, a vertical portion of the conduit has to be made, which implements a kind of connection capable of driving the gas in the vertical direction between the two conduits (Venturi, chamber).

The transition from the horizontal Venturi pipe and the vertical connection may be carried out by a conventional bend of 90°.

However, such solution causes, as is well known, a certain aerodynamic resistance and a consequent gas swirling, what reduces both the flow rate and uniformity.

In order to avoid such a drawback, the vertical connection is properly provided with a specific deflector 31, which eases the change of gas direction and reduces the generated turbulence.

A further problem is caused by the fact that the two Venturi pipes are very close and also a little angulated from each other, and so they get the same peripheral portion of the burner body, and as each Venturi pipe has to enter the respective gas diffusion chamber, and finally as the two gas diffusion chambers 21, 22 are semi-circular, it is a logical consequence that the two Venturi pipes feed the respective chambers 21, 22 in two respective zones which necessarily are placed at respective extreme sides 21B, 22B of the respective chambers.

It was also realized, and it was also foreseeable by the man skilled in the art, that the fact of feeding the gas at the extreme side of each gas diffusion chamber causes an irregular gas distribution inside the chamber itself, which obviously compromises an even combustion and flame combustion.

Figure 8:
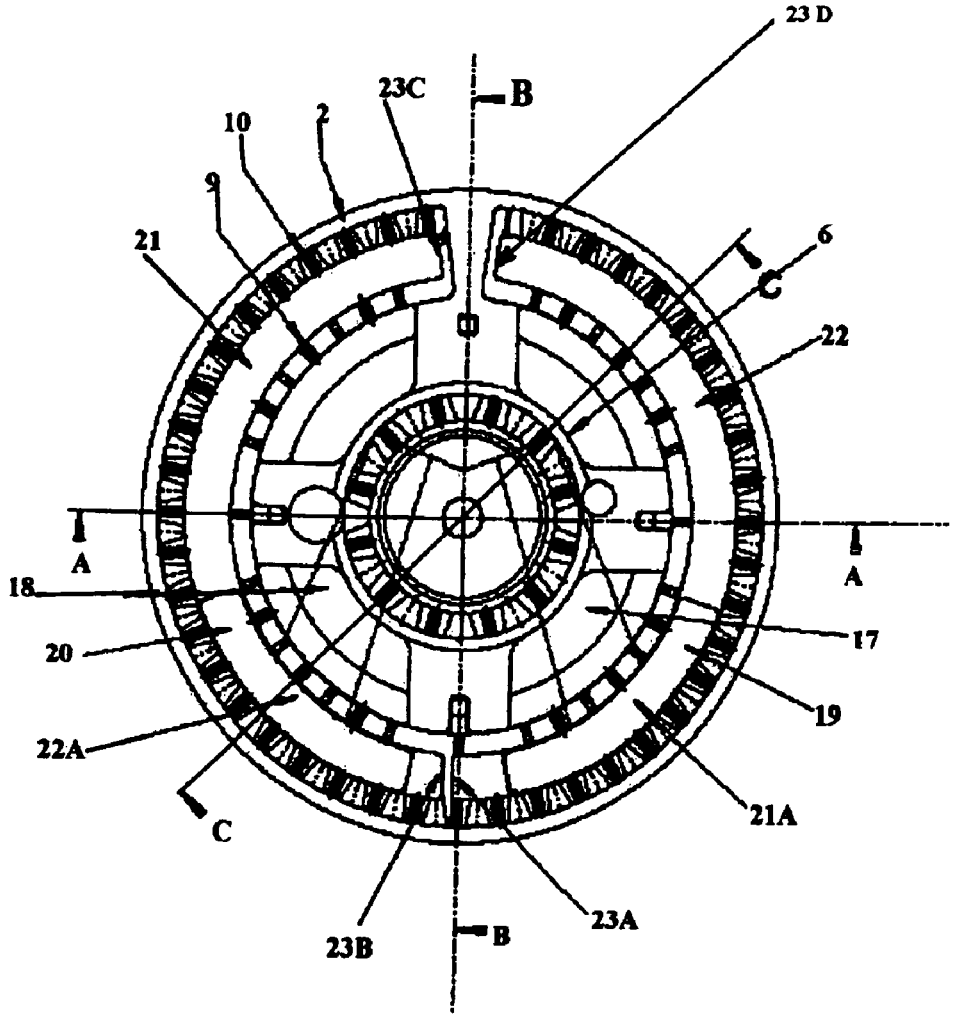
FIG. 8 shows a top plan view of the portion of the burner of FIG. 7, deprived of the covers of the chambers diffusing the gas.
Figure 9:
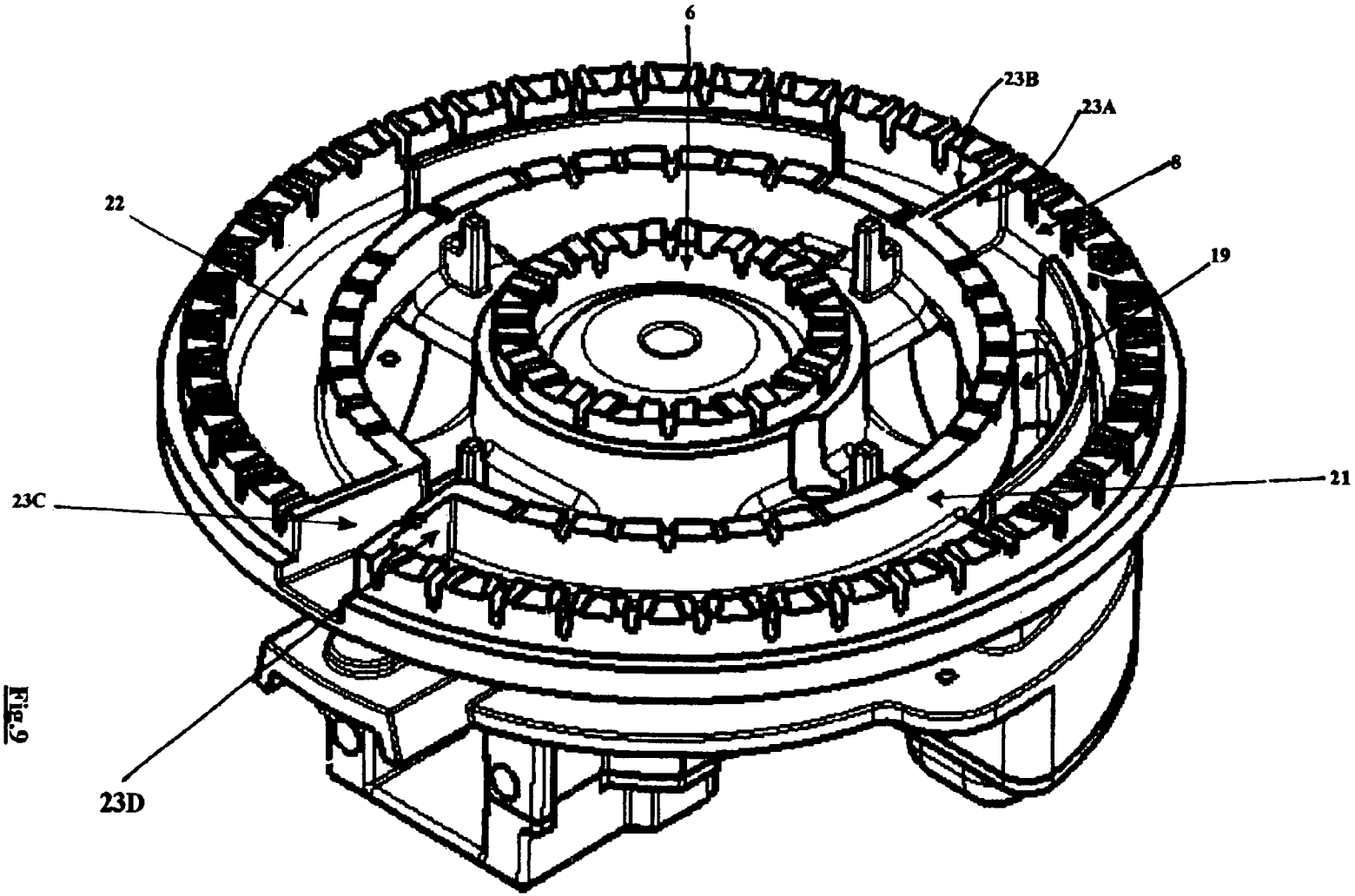
FIG. 9 shows a schematic perspective view of the upper crown of the burner body of FIG. 8.

In order to overcome such a drawback, and with reference to FIGS. 7 and 8, the Venturi pipes are so sized and angulated to each other so that they enter not into the extreme side of the respective gas diffusion chambers 21, 22, but in respective zones 21A, 22A (FIG. 7) which are remarkably far from the extreme sides 21B, 22B (FIG. 6).

This is logically possible by making the two Venturi pipes sufficiently diverge, but avoiding that the provision would shorten the length of the same Venturi pipes too much.

However, the fact of introducing the Venturi pipes into an intermediate zones of the respective chambers determines the need that the gas flow to be split into two separate, and basically opposed 180° flows; as a matter of fact, it is just what is wanted, if it is desired that the gas entered into an intermediate zone of the relevant chamber be split into two flows, each of them goes into a respective portion of the gas diffusion chamber.

But in this case the problem to change the direction of the gas flow into two opposed directions is raised, which causes further gas turbulence.

In order to avoid the risk of sharp bending of the gas conduits 19, 20 too, what (as just explained) would harm the gas flow uniformity and delivery, on the terminal portion of the Venturi pipes respective symmetrical connections 25, 26 are arranged, having a double-face deflector, as shown in the FIG. 7.

The invention claimed is:

1. A gas burner provided with a plurality of concentric and circular flame crowns, said gas burner comprising:

a first central burner configured to supply a first peripheral flame ring;

a second annular burner surrounding said first central burner at a predetermined distance so as to form a substantially ring shaped chamber having an inner wall and an outer wall, and configured to supply at least a second peripheral flame ring;

a burner body configured to be mounted on a surface of a cooking hob;

a first gas inlet in communication with said burner body, a first gas injector having a vertically oriented axis;

said first central burner having a first chamber configured to diffuse an air/gas mixture, said first chamber having a top and a plurality of ports configured and arranged so as to let the air/gas mixture out, being placed on an upper edge of said first burner, and having said top of said first chamber closed by a first cover; and a second gas inlet in communication with said burner body, wherein said substantially ring shaped chamber of said second annular burner includes a first chamber and a second chamber, said first and second chambers being separate chambers and being configured to diffuse the air/gas mixture, each chamber of said first and second chambers having a top and a plurality of ports configured and arranged so as to let the air/gas mixture out, and being placed on an upper edge of said second annular burner, and said top of each of said first and second chambers being closed by a second cover, wherein said second gas inlet is in communication with said first and second separate chambers through an injection and conveying device, said injection and conveying device comprising:

a first injector and a second injector, said first and second injectors being distinct and being in communication with said second gas inlet; and first and second Venturi pipes horizontally disposed, each of said first and second Venturi pipes being configured to supply the air/gas mixture to said first and second diffusion chambers, respectively wherein said first and second diffusion chambers are physically separate and not in communication to each other, wherein said first and second injectors are horizontal and separate from each other injector and are placed on a first end of said second gas inlet wherein said first and second injectors are placed in a lower portion of said burner body and substantially in a portion of a first side of said burner body, and are oriented towards a second side of said burner body, said second side being opposite said first side and wherein said horizontal first and second injectors separate from said second gas inlet with an acute angle.

2. Gas burner according to claim 1, wherein said first and second Venturi pipes are symmetrically positioned with respect to a vertical central axis of said gas burner.

3. A gas burner according to claim 1, wherein each of said first and second diffusion chambers include a deflection device configured to deflect a flow of the air/gas mixture coming from the first and second Venturi pipes, respectively.

4. A gas burner according to claim 3, wherein each of said deflection devices of said first and second diffusion chambers is implemented through a bending oriented upwards and shaped and smoothed, and arranged at the end of said first and second Venturi pipes, respectively.

5. A gas burner according to claim 3, wherein said deflection devices are implemented through first and second opposed and properly smoothed bendings arranged on first and second ends of said first and second Venturi pipes, respectively.

6. A gas burner according to claim 1, wherein said first and second injectors are horizontal and separate from each other and are placed on a first end of said second gas inlet.

7. A gas burner according to claim 6, wherein each of said first and second diffusion chambers include a deflection device configured to deflect a flow of the air/gas mixture coming from the first and second Venturi pipes, respectively.

8. A gas burner according to claim 2, wherein each of said first and second diffusion chambers include a deflection device configured to deflect a flow of the air/gas mixture coming from the first and second Venturi pipes, respectively.

9. A gas burner according to claim 4, wherein said deflection devices are implemented through first and second opposed and properly smoothed bendings arranged on first and second ends of said first and second Venturi pipes, respectively.

10. A gas burner according to claim 7, wherein said deflection devices are implemented through first and second opposed and properly smoothed bendings arranged on first and second ends of said first and second Venturi pipes, respectively.

11. A gas burner according to claim 1, wherein at least one of said plurality of ports is disposed in said inner wall and at least one of said plurality of ports is disposed in said outer wall.

12. A gas burner according to claim 1, wherein said first and second chambers are configured are arranged so as to not be in communication with each other.

* * * * *

UNITED STATES PATENT AND TRADEMARK OFFICE

CERTIFICATE OF CORRECTION

PATENT NO. : 8,221,116 B2
APPLICATION NO. : 12/309971
DATED : July 17, 2012
INVENTOR(S) : Nico Biagioli et al.

It is certified that error appears in the above-identified patent and that said Letters Patent is hereby corrected as shown below:

Title Page, Item (87) should read:

(87) PCT Pub. No.: WO2009/053125

PCT Pub. Date: April 30, 2009

Signed and Sealed this
Ninth Day of April, 2013

Teresa Stanek Rea
*Acting Director of the United States Patent and Trademark Office*